United States Patent [19]

Astle

[11] 3,993,211

[45] Nov. 23, 1976

[54] CONTAINER

[75] Inventor: Miles Henry Astle, London, England

[73] Assignee: John Dale Limited, London, England

[22] Filed: June 24, 1975

[21] Appl. No.: 589,985

[30] Foreign Application Priority Data

Jan. 1, 1975 United Kingdom ..... 00813/75

[52] U.S. Cl. ..... 220/1.5; 220/4 F

[51] Int. Cl.[2] ..... B65D 7/32

[58] Field of Search ..... 220/1.5, 4 F, 21; 217/12 R, 43 A, 12 A, 43 R

[56] References Cited

UNITED STATES PATENTS

| | | | |
|---|---|---|---|
| 2,507,158 | 5/1950 | Hines | 220/4 F |
| 2,644,602 | 7/1953 | Ross | 217/12 R |
| 2,685,398 | 8/1954 | King | 220/1.5 |
| 2,701,174 | 2/1955 | Franks | 220/4 F |
| 2,964,210 | 12/1960 | Paley | 220/4 F |
| 3,250,421 | 5/1966 | Braun | 220/4 F |
| 3,480,178 | 11/1969 | Morgan | 220/21 |
| 3,528,583 | 9/1970 | Taylor | 220/4 F |
| 3,672,530 | 6/1972 | Bridenstine et al. | 220/307 |

*Primary Examiner*—William T. Dixson, Jr.
*Assistant Examiner*—Allan N. Shoap
*Attorney, Agent, or Firm*—Beveridge, DeGrandi, Kline & Lunsford

[57] ABSTRACT

A storage container, such as a crate or bin, which may be formed of plastics material, and which is adapted for transportation by a fork lift truck, comprises a base having a generally level upper surface and four similar sides adapted for mounting perpendicularly to the base. The base is formed with a pair of substantially parallel downwardly facing channels, constituted by walls which are integrally formed with the base and are disclosed above the general level of the base. The lower edge of each side is recessed to accommodate the ends of the channels, each recess having an inner margin which is spaced upwardly from the lower edge of the side. Each side is mounted on the base by complementary engagement between the lower edge of the side and the periphery of the base, at least at the inner margins of the recesses and between the recesses. Preferably this complementary engagement is provided by a groove in each side along at least the inner margins of the recesses and between the recesses, and corresponding lateral projections on each edge of the base which are engaged within a respective one of the grooves when the container is assembled.

6 Claims, 9 Drawing Figures

CONTAINER

This invention relates to containers, and particularly to storage containers such as crates or bins having a base and four sides mounted perpendicular to the base, and which are adapted for transportation by a fork lift truck.

According to one aspect of the present invention there is provided a container comprising a base having a generally level upper surface and a pair of substantially parallel downwardly facing channels, constituted by walls which form part of the base and are disposed above the general level of the base, and four similar sides adapted for mounting perpendicularly to the base, the lower edge of each side being recessed to accommodate the ends of the channels, each recess having an inner margin which is spaced upwardly from the lower edge of the side, there being provided complementary engaging means on the base and on each side, and that there is engagement of the base and each side at least at the inner margins of the recesses and between the recesses.

According to another aspect of the present invention, there is provided a container comprising a base having a generally level upper surface and a pair of substantially parallel downwardly facing channels, constituted by walls which form part of the base and are disposed above the general level of the base, and four similar sides adapted for mounting perpendicularly to the base, the lower edge of each side being recessed to accommodate the ends of the channels, each recess having an inner margin which is spaced upwardly from the lower edge of the side, there being a groove in each side along at least the inner margins of the recesses and between the recesses, and corresponding lateral projections on each edge of the base which are each positioned for engagement within a respective one of said grooves.

Preferably each side is provided with a continuous groove along its lower edge and around the inner margins of the recesses. The base may be provided with a continuous laterally projecting rim which is shaped for engagement with the continuous grooves in each of the four sides, the rim being disposed about the periphery of the base so that it is raised above the general level of the base around the ends of the channels on the respective two opposite edges of the base and at points on the other two edges of the base which correspond to the location of the recesses in the two sides adjacent said other two edges.

Elongate slots may be provided in each side along the inner margin of each recess and along an intermediate portion of the lower edge of the side, and in which the base is provided with corresponding laterally extending tongues which are each positioned about the periphery of the base, for engagement with a respective one of the slots, there being one of said tongues located on the upper wall of each end of each channel for engagement with the slot along the inner margin of the respective recess in the adjacent side, respective ones of the tongues on the other two sides of the base being raised above the general plane of the base so as to engage with the respective slots located along the inner margins of the respective recesses in the other two sides of the crate.

Each of the sides may include a plurality of window openings, separated by mullions which are smoothly convex towards the inside of the container. Similarly the base may include a plurality of window openings separated by mullions which are smoothly convex towards the inside of the container. The sides may be bolted together at the corners of the crate which are preferably bevelled.

Reference will hereinafter be made to the accompanying drawings which illustrate, by way of example one embodiment of the invention and of which:

Figure 1:
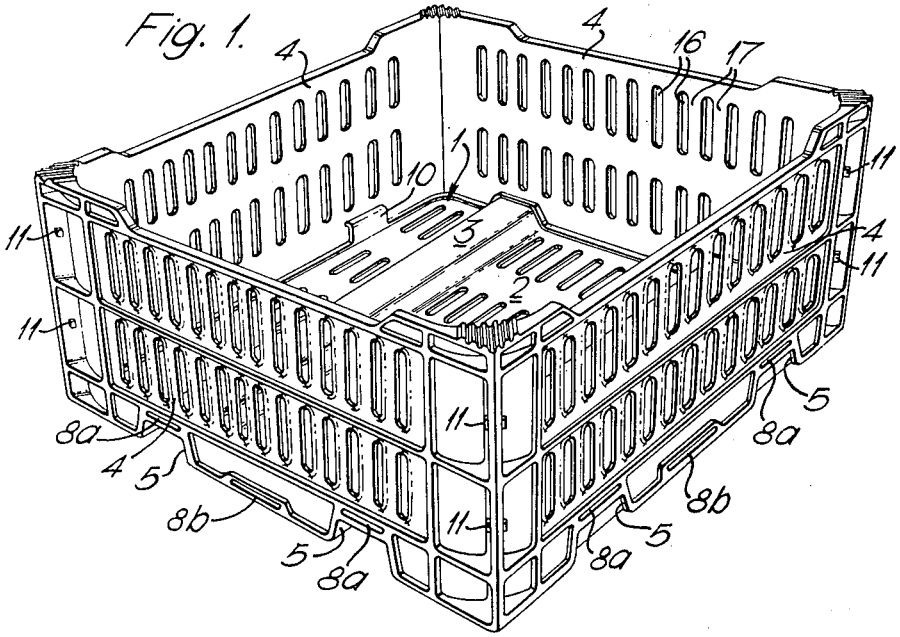
FIG. 1 is a respective view from above of a crate according to the invention.
Figure 3:
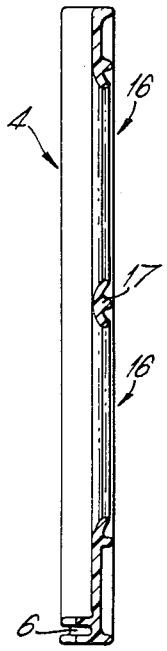
FIG. 3 is a sectional view of the sides of FIG. 2 along the lines III — III.

In the drawings the crate has a base 1 with a substantially level upper surface 2 in which a pair of parallel downwardly facing channels 3 are formed, the channels being constituted by walls 3*a* which rise above the surface 2. The channels are suitably sized and spaced to permit the entry of the tines of a fork lift truck in order that the crate may be lifted and transported thereby.

Figures 6, 7:
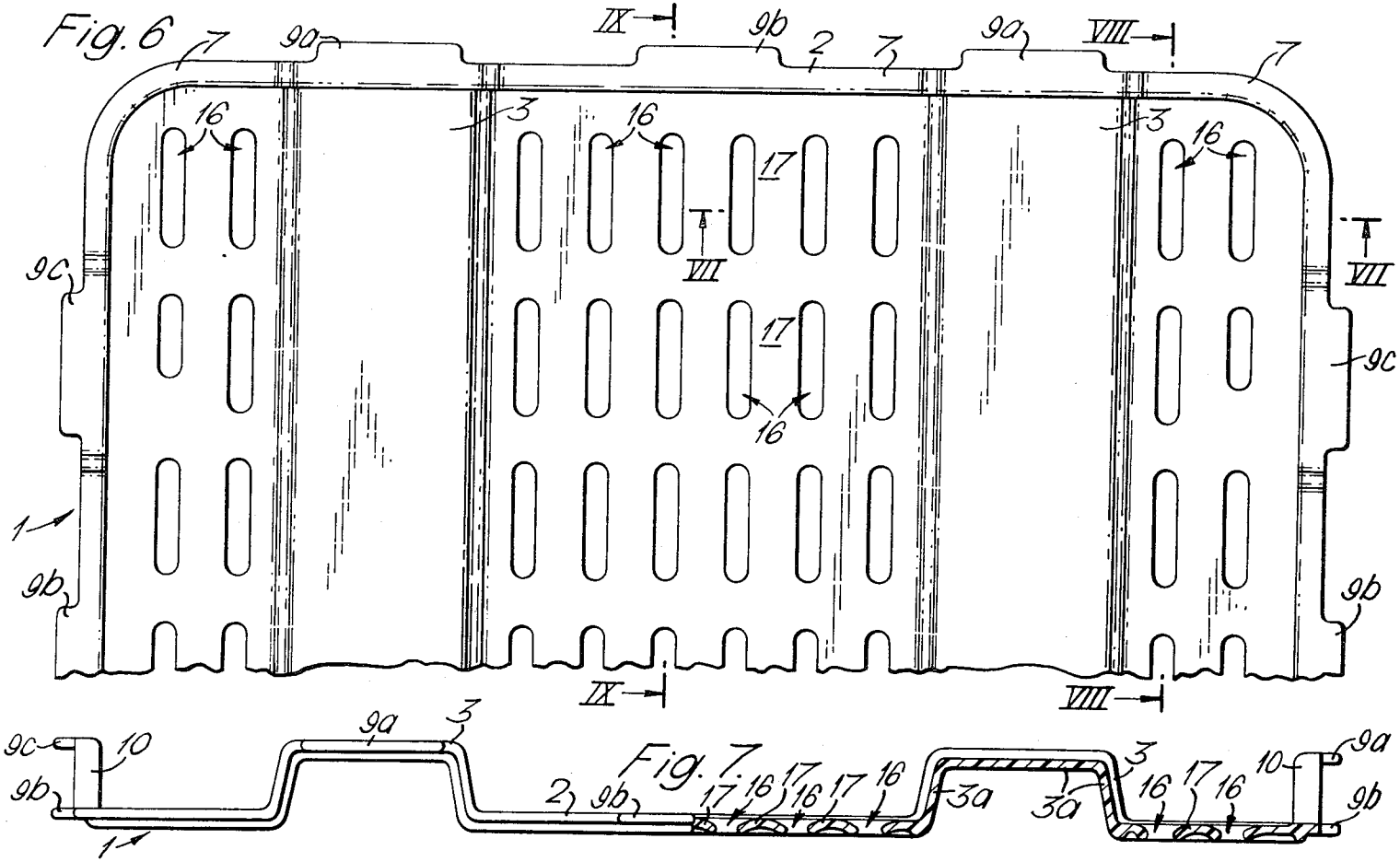
FIG. 6 is a plan view of half the base of the crate of FIG. 1.
FIG. 7 is a side view of the base of FIG. 6; incorporating a sectional view along line VII — VII.

In the embodiment shown, the crate base has only one pair of channels 3, so that the tines can penetrate the crate from two opposite directions only. A second pair of parallel channels similar to and orientated at right angles to the channels shown in the FIGS. 6 and 7 may be incorporated to permit four-way penetration of the crate.

The crate has four similar sides 4 which are substantially planar, each side 4 including two recesses 5 in the lower edge thereof, each recess 5 being of the same dimensions and shaped as the exterior surface of the channels 3 on the base 1, in order to be able to accommodate the end of a channel when the crate is assembled. In this embodiment where the base is adapted for two-way entry only, as described above, the ends of the channels 3 are accommodated in the recesses of two opposite sides only of the assembled crate, the recesses of the other two sides being closed off as described below.

Figure 4:
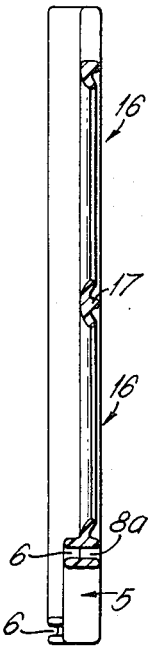
FIG. 4 is a sectional view of the side of FIG. 2 along the line IV — IV.
Figure 5:
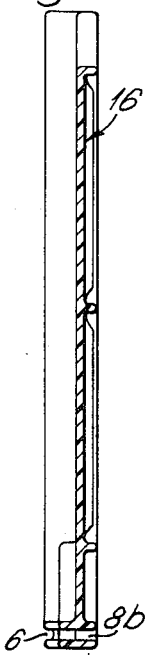
FIG. 5 is a sectional view of the side of FIG. 2 along the line V — V.
Figure 8:
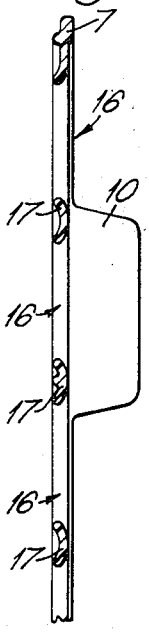
FIG. 8 is a sectional view of the base of FIG. 6 along line VIII — VIII.
Figure 9:
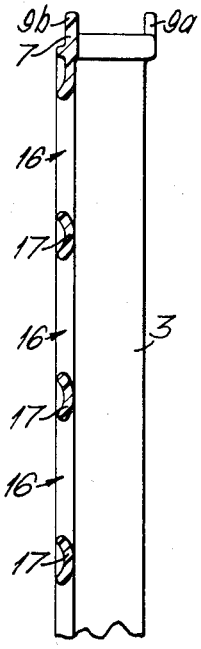
FIG. 9 is a sectional view of the base of FIG. 6 along line IX — IX.
Figure 2:
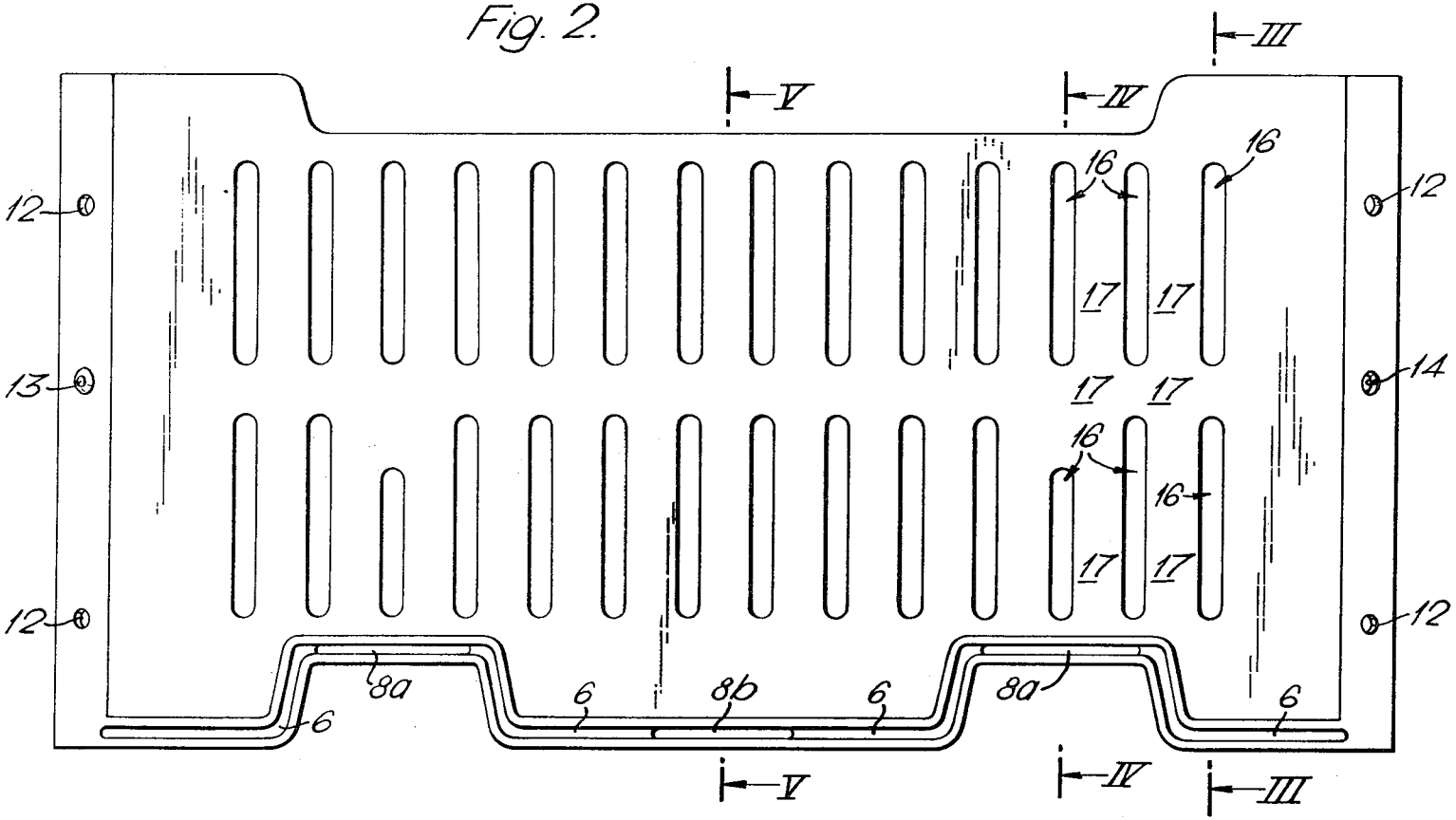
FIG. 2 is an elevation of the inner surface of a side of the crate of FIG. 1.

In order that the sides of the assembled crate are securely mounted on the base, complementary engaging members are provided on the lower edge of each side and on each edge of the base. In this embodiment, the engaging members take the form of a continuous groove 6 along the lower edge of each side 4, each groove 6 following the contour of the recesses 5 in the side, as shown in FIG. 2. The periphery of the base 1 is provided with a corresponding continuous laterally projecting rim 7 (FIG. 6) which is engaged within the groove 6 of each of the sides when the crate is assembled. In addition, the groove 6 in each side 4 is developed along the inner edge of each recess (see FIGS. 2 and 4) to form slots 8*a* and midway between the two recesses (see FIGS. 2 and 5) to provide slots 8*b* which engage correspondingly shaped tongues 9 on the base, which are formed by longer laterally extending portions of the rim 7. Along each of the two edges of the base of the present embodiment on which the ends of the channels 3 are located, a tongue 9*a* is located along the end of the top wall of each channel 3 respectively and a third tongue 9*b* is located along an intermediate portion. Along the other two edges of the base, as before a tongue 9*b* is formed along an intermediate portion as above, the other two tongues 9*c* on each of these two sides being raised above the general level of the base by respective supports 10 (FIGS. 7 and 9) to a level corresponding to that of the tongue 9*a* above the channels, so that the tongues 9*c* can engage the slots 8 above the recesses in the sides which do not accommodate the ends of one of the channels. Each of these recesses is closed off when the crate is assembled by the respective support 10, since the rim 7 on the base at that point is carried by the support 10 to follow the path of the part of the groove 6 which surrounds the recess. Thus there is secure engagement between the base and each side on two distinct levels i.e. on the general level of the base, and on the level of the top of the channels.

It would be possible for the continuous rim 7 on the base to be replaced by, for example, a plurality of projections which each penetrate a part of the groove 6 on the sides, in which case the groove 6 need not be continuous and may be formed by a corresponding number of discrete groove portions which may be elongate, other suitable means of engaging the base with the sides on the two levels i.e. at least at the inner margins of the recesses and between the recesses, are also possible.

Preferably, the sides are detachably mounted on the base in order that the crate may be dismantled for ease of transportation of the empty crate. The sides are preferably bolted together at the corners which are bevelled as shown by pairs of bolts 11 (FIG. 1) which pass through holes 12 (FIG. 2) in the sides. A projection 13 may be provided in one end of each side and a corresponding shaped recess 14 in the other end so that each projection engages in the corresponding shaped recess 14 in the end of the adjacent side which forms a corner therewith when the crate is assembled, to assist in the correct location of the sides with respect to each other. The upper and lower surfaces of each end of each of the sides may be formed with a series of grooves 15, as shown in FIG. 1 in which the upper grooved surfaces of each side are illustrated, to assist in the stacking of a series of crates one above the other.

The advantage of the construction described hereinbefore is that it is possible to mould the crate from plastics material and ensure that the inside of the crate does not have any sharp edges. In this embodiment the four sides and the base also are provided with rows of windows or openings 16 separated by mullions 17 which are smoothly convex towards the inside of the crate.

I claim:

1. A container comprising a base having a generally level upper surface and a pair of substantially parallel downwardly facing channels extending from one side of the base to the opposite side, constituted by walls integral with said upper surface and projecting above the upper surface; and four similar side walls which are adapted for mounting perpendicular to the base along the sides thereof, the lower edge of each side wall including a pair of recesses of which the inner margins are spaced upwardly from the lower edge of the side wall, each recess being located and shaped for the accommodation of one end of one of said channels in the base so that when the side walls are mounted on the base, the ends of the channels are accommodated within the recesses in the lower edges of two opposed side walls, the recesses in the other two side walls being vacant, there being a continuous groove in each side wall along its lower edge and around the inner margins of the recesses therein and a continuous laterally projecting rim on the base which is shaped for engagement with the continuous grooves in the four side walls, the rim being disposed around the base so that it is raised above the upper surface of the base around the ends of the channels on the respective opposite sides of the base and at points on the other two sides of the base which correspond to the location of the vacant recesses in the said other two side walls, the groove in each side wall being deepened along at least a portion of the inner margin of each recess and along a portion of the lower edge of the side wall between the recesses, the respective parts of the rim on the base being correspondingly laterally extended for accommodation within the deepened portions of the grooves in the side walls.

2. A container as claimed in claim 1, in which the deepened portions of the groove in each side wall constitutes elongate slots which pierce the side wall.

3. A container as claimed in claim 1, in which each of the side walls includes a plurality of window openings, separated by mullions which are smoothly convex towards the inside of the container.

4. A container as claimed in claim 1, in which the base includes a plurality of window openings separated by mullions which are smoothly convex towards the inside of the container.

5. A container as claimed in claim 1, in which the side walls are bolted together at the corners of the container.

6. A container as claimed in claim 1, in which the corners of the container are bevelled.

* * * * *